US006843443B2

(12) United States Patent
Crom et al.

(10) Patent No.: US 6,843,443 B2
(45) Date of Patent: Jan. 18, 2005

(54) HYBRID WIRE WINDER AND SEISMIC CABLES

(75) Inventors: Michael Crom, Reno, NV (US); Frank Lucido, Reno, NV (US); Sean Crom, Reno, NV (US)

(73) Assignee: DYK Incorporated, El Cajon, CA (US)

( * ) Notice: Subject to any disclaimer, the term of this patent is extended or adjusted under 35 U.S.C. 154(b) by 191 days.

(21) Appl. No.: 09/965,646

(22) Filed: Sep. 26, 2001

(65) Prior Publication Data

US 2002/0074444 A1 Jun. 20, 2002

Related U.S. Application Data

(60) Provisional application No. 60/235,404, filed on Sep. 26, 2000.

(51) Int. Cl.[7] ..... B65H 54/64

(52) U.S. Cl. ..... 242/438.1; 242/439.5

(58) Field of Search ..... 242/438, 438.1, 242/439.5, 440.1, 443, 445.1

(56) References Cited

U.S. PATENT DOCUMENTS 2,364,696 A * 12/1944 Maurice ..... 242/438.1
3,338,527 A * 8/1967 William ..... 242/438
4,744,065 A * 5/1988 Higraff et al. ..... 367/191
5,114,086 A * 5/1992 Ho ..... 29/605
5,133,510 A * 7/1992 Davis et al. ..... 242/438.1
5,177,919 A * 1/1993 Dykmans ..... 52/298
5,271,081 A * 12/1993 Khalil ..... 385/112
5,274,603 A * 12/1993 Zibilich et al. ..... 367/20
5,289,669 A * 3/1994 Gerber et al. ..... 53/415
6,089,493 A * 7/2000 Moore ..... 242/438.1
6,113,343 A * 9/2000 Goldenberg et al. ..... 414/729
6,290,166 B1 * 9/2001 Aramaki et al. ..... 242/484.4
6,390,406 B1 * 5/2002 Wood ..... 242/443
6,401,333 B1 * 6/2002 Suzuki et al. ..... 29/848
6,417,479 B1 * 7/2002 Becherucci et al. ..... 219/110

* cited by examiner

*Primary Examiner*—Emmanuel Marcelo
(74) *Attorney, Agent, or Firm*—Stetina Brunda Garred & Brucker

(57) ABSTRACT

A winder has an extra section. The extra section includes a gripper; and a brake, for controlling a wire force without having to change a pitch diameter of the gripper or a sprocket. The wire winder, is controlled by, as a tower travels around a tank, generating a square wave from the wheel drive; feeding said square wave to a counter and counting the square waves; comparing the number of counts with a number selected by an operator for a spacing location; powering a proportional hydraulic valve, and thereby pressurizing fluid into an elevator hydraulic motor; thereby rotating the motor until the spacing counter has counted the pre-selected number; and shutting the hydraulic flow. Epoxy is used to protect seismic cables from liquids.

15 Claims, 5 Drawing Sheets

HYBRID WIRE WINDER AND SEISMIC CABLES

CROSS-REFERENCES TO RELATED APPLICATIONS

This converts Provisional Application Ser. No. 60/232,134, filed Sep. 13, 2000, to a Utility Patent Application, and takes priority from that Provisional Application which claims the benefit of Provisional Application No. 60/235,404, filed Sep. 26, 2000.

BACKGROUND OF THE INVENTION

1. Field of the Invention

The present invention relates to the field of pre-stressed reinforced concrete tanks for the containment of liquids. The invention relates particularly to a mechanical device for winding the reinforcing wire or cable. It relates further to electronics for controlling the winding. It relates further to reinforcing said tanks against seismic forces.

2. Description of Related Art Including Information Disclosed Under 37 CFR 1.97 and 1.98

Concrete tanks are often constructed using machines to pre-stress a cylindrical structure by continually wrapping a wire cable or tape around the structure. They are also used to spray a protective shotcrete cover coat over and under the prestressing materials. The pitch for either process is controlled by raising or lowering an elevator that is housed in a tower that continually rotates around the structure. This raising and lowering can take place once per revolution of the tower or in fractions of a revolution.

Examples of such machines are in U.S. Pat. No. 3,666,189 issued May 30, 1972 and U.S. Pat. No. 4,884,747 issued Dec. 5, 1989, both to Dykmans. Other patents are U.S. Pat. No. 2,797,878; to Crom; and U.S. Pat. No. 4,801,103 to Preload.

SUMMARY OF THE INVENTION

The purpose of this invention is to provide a machine capable of prestressing concrete tanks, silos, buildings, nuclear containers, pipes, columns, etc. by continually wrapping a steel or carbon fiber element around the said structure with a controlled force.

Another purpose of this invention is to provide a simple, durable and accurate control system for use in circumferential pre-stressing machines. These machines are used to prestress a structure, often a cylindrical structure, by continually wrapping a wire, cable, or tape around the structure. They are also used to spray a protective shotcrete cover coat over and under the prestressing materials. The pitch for either process is controlled by raising or lowering an elevator that is housed in a tower that continually rotates around the structure. This raising and lowering can take place once per revolution of the tower or in fractions of a revolution.

Another object of the invention is to improve the corrosion resistance of seismic cables used in the field of circular concrete water retaining structures, by coating the seismic cables with epoxy.

DESCRIPTION OF THE PREFERRED EMBODIMENTS

Figure 1:
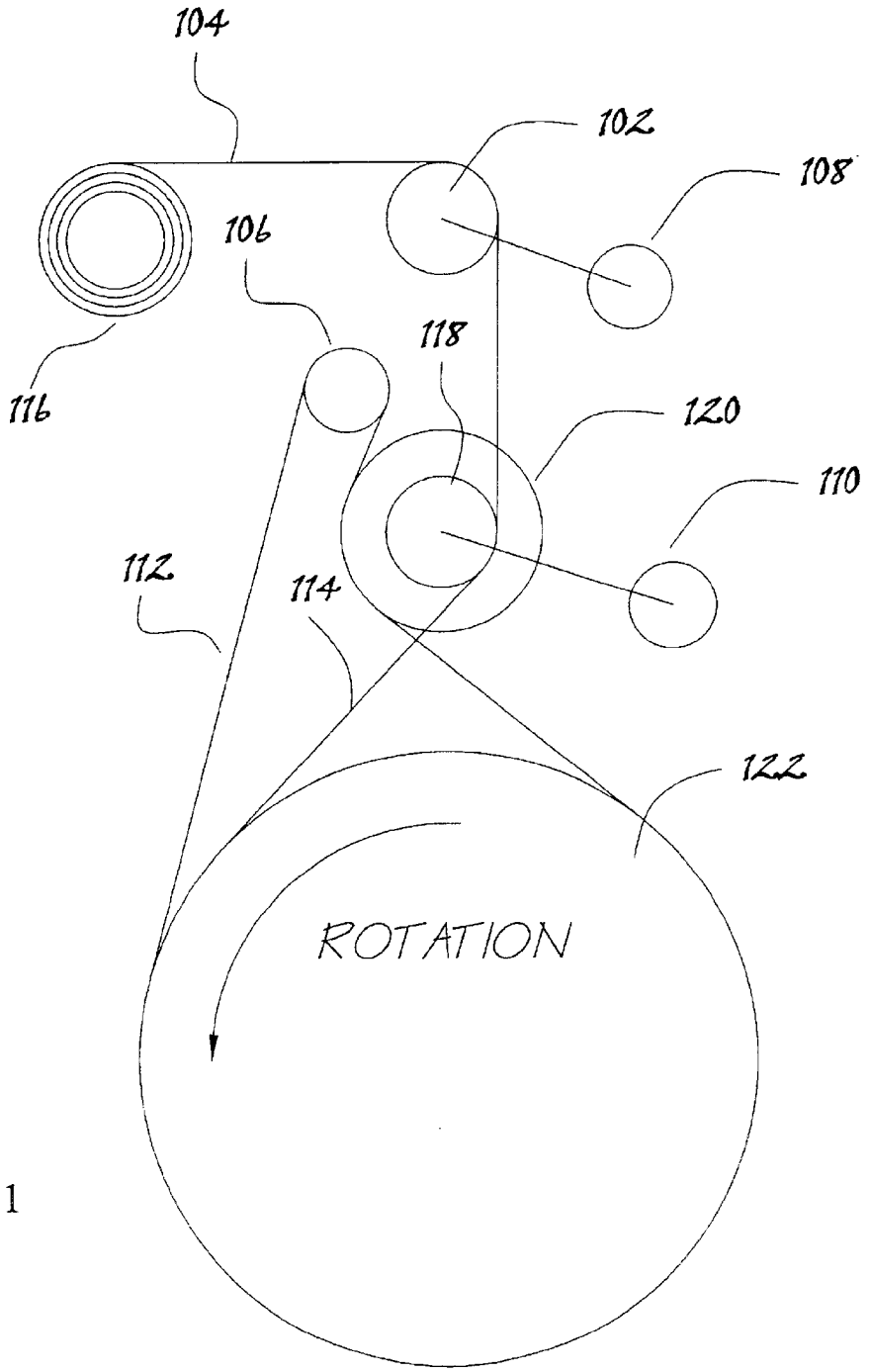
FIG. 1 is a block diagram in the nature of a schematic of the mechanical aspects of the winder.

As shown in FIG. 1, the Hybrid winder arrangement consists of a differential winder such as described in U.S. Pat. No. 2,749,054 with an extra section that consists of gripper 102 and brake 108. The extra section allows for controlling wire tension at 114 without having to change the pitch diameter of gripper 118 or sprocket 120.

The novelty of this invention is that a stationary brake is used to control the force of the applied wire. This brake should be controlled by a PID controller, which receives feedback from wire tension. Such a brake can be liquid cooled much more easily than the clutch described in U.S. Pat. No. 2,797,878. It is also not necessary to use gearboxes or chains to reduce the torque transmitted to the frictional element such as in U.S. Pat. No. 4,801,103.

Description of Operation

Un-tensioned wire from spool 116 enters gripper 102, which is controlled by a brake 108. After leaving gripper 102, the wire, which has an initial tension developed by brake 108, enters a second gripper 118. Because of the difference in pitch circumference between sprocket 120 and gripper 118, additional tension is developed in the wire by the differential method of U.S. Pat. No. 2,749,054.

For example, consider the case where a 0.192 inch diameter steel wire is to carry a load of 4500 lbs. Say sprocket 120 has a pitch circumference of 68.024 inches and gripper 118 has a pitch circumference of 67.6 inches. The difference in pitch circumference (d) is then 0.424 inches. It can be shown that the force generated is:

$$\text{Force wire}=d/((68.024+d/2.133*10^6)+(68.024/0.02895*E_{wire}))$$

Where $E_{wire}$ is $29*10^6$ psi and d is 0.424 inches, Force wire becomes 3801 lbs.

Since a force of 4500 lbs. is desired, an additional 699 lbs of force must be generated by the gripper 102. If the pitch radius of gripper 102 is 110 inches, brake 108 must apply a torque of:

$$699\ \text{lbs.}*10\ \text{inches}=6990\ \text{inch-lbs.}$$

Motor 110 is used to keep the system in equilibrium.

Although in FIG. 1 the winder is shown as stationary and the structure as rotating, it is also possible to have the winder rotate around a stationary structure.

Winder Electronics

Another purpose of this invention is to provide a simple, durable and accurate control system for use in circumferential prestressing machines. These machines are used to prestress a cylindrical structure by continually wrapping a wire, cable, or tape around the structure. They are also used to spray a protective shotcrete cover coat over and under the prestressing materials. The pitch for either process is controlled by raising or lowering an elevator that is housed in a tower that continually rotates around the structure. This raising and lowering can take place once per revolution of the tower or in fractions of a revolution.

Description of Operation

Figure 2:
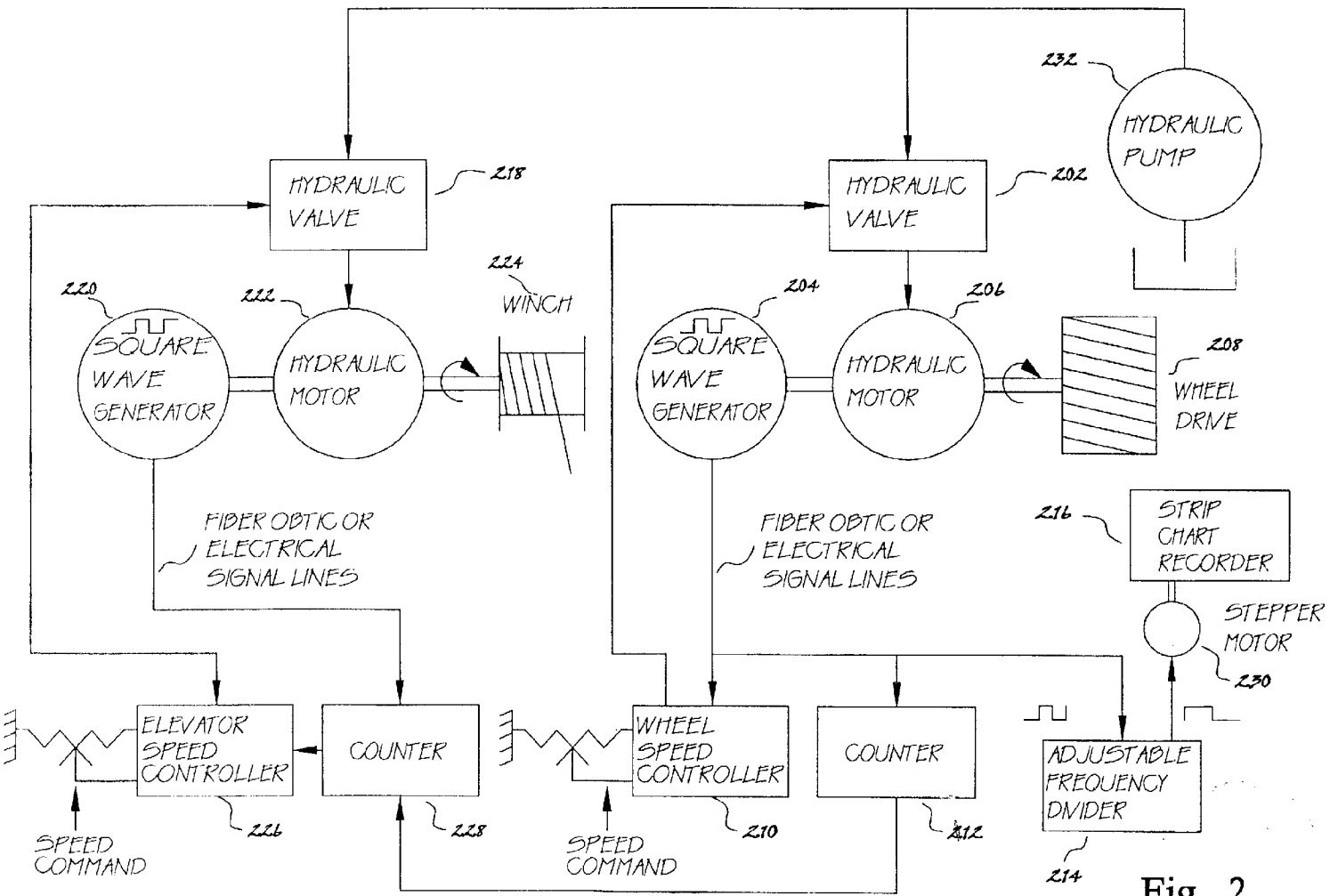
FIG. 2 is a block diagram in the nature of an electrical schematic of the winder control.

FIG. 2 shows the required mechanical and electrical components for this invention. To start the process the operator adjusts the speed command on wheel speed controller 210. As the tower travels around the tank a square wave is generated from the generator 204. This signal, which can be optical or electrical, is fed to a counter 212, that compares the number of counts with the number selected by the operator for the spacing location. For example, if the generator generates 1000 counts per revolution around the tank and the operator desires elevator spacing twice per every revolution around the tank, the operator would select 500 counts as the spacing location. When the counter reaches 500 counts it immediately resets itself and sends a signal to the spacing counter 228. The spacing counter immediately sends power to a proportional hydraulic valve 218, which allows pressurized fluid into the elevator hydraulic motor 222. The motor continues to rotate until the spacing counter 228 has counted the pre-selected number of counts and then shuts off the hydraulic flow. Similar to the spacing location, the pre-selected number of counts corresponds to a desired spacing increment.

The square waves generated from the wheels and elevator motor can be from quadrature output optical encoders or commutator rings. Many prestressing machines are equipped with a strip chart recorder that records information from various transducers as the machine travels. It is convenient to have the paper fed in direct relation to the movement of the tower so that the location of events can be related to the events. Another benefit of having such a system is that it relieves the operator from having to turn the recorder on and selecting an appropriate paper speed. Again referring to FIG. 2, the adjustable frequency divider 214 has an output frequency that is an integer multiple of the input frequency. The square wave that leaves the frequency divider drives a stepper motor 230 one step for every logic high. These steps are in such small increments that they are not discernable to humans.

Another use for the square wave generated by the wheels and/or winch drum is to provide feedback for low cost proportional valves. While these valves do not have the accuracy of servo valves, they are more than sufficient for use in prestressing machines and are less dirt sensitive than servo valves.

Seismic Cables

Figure 3:
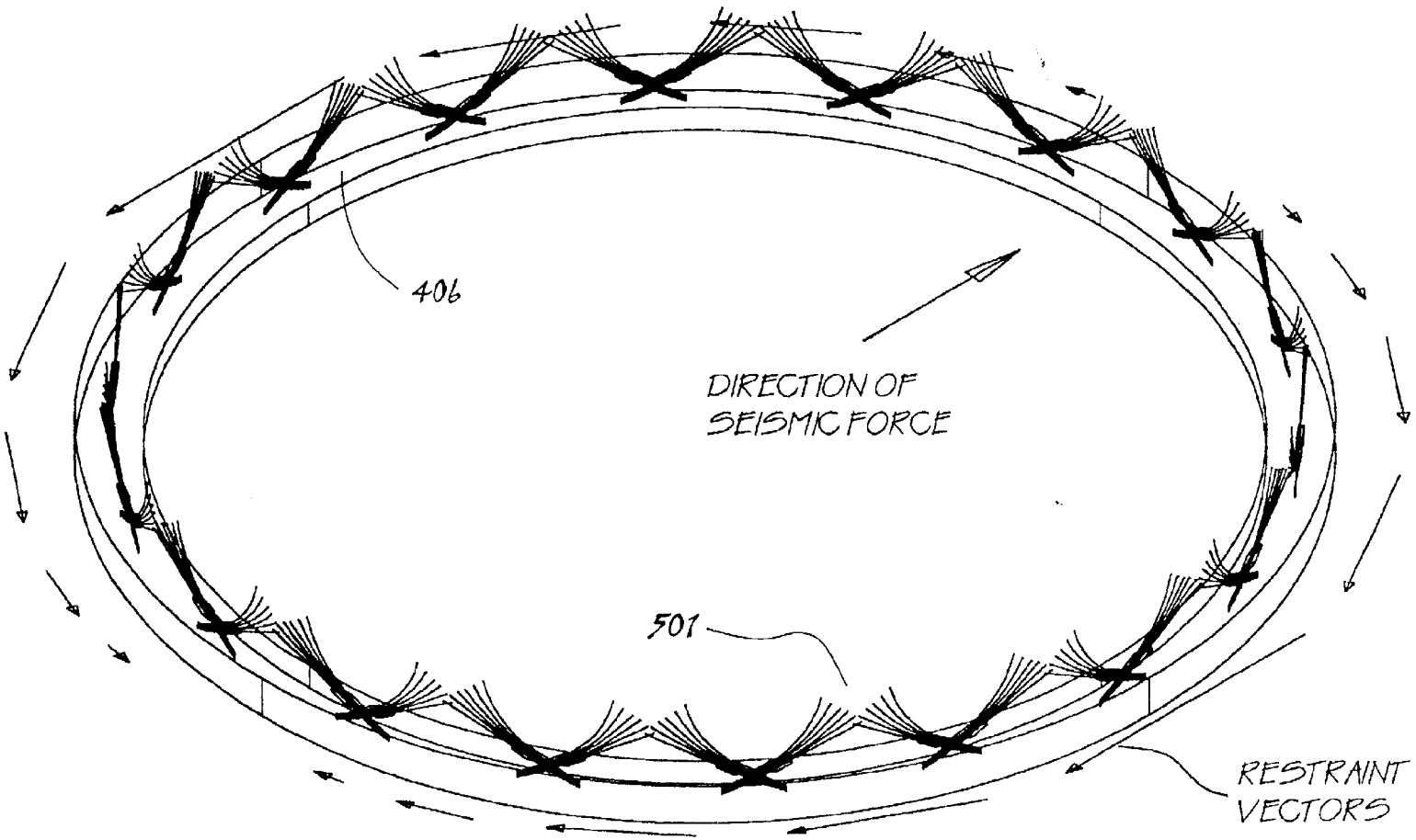
FIG. 3 is a perspective view of the seismic cables embedded in a base of a tank.

This aspect of the invention is intended to improve the corrosion resistance of seismic cables used in the field of circular concrete water retaining structures. Seismic restraint cables, which are placed between a concrete footing and the tank wall as shown in FIG. 3, are used to transmit seismic force from the tank wall to footing. The magnitude of the force on each cable is related to its stiffness with respect to the direction of seismic acceleration. The length of the restraint vectors gives an indication of magnitude. They point in the direction of action.

Figure 4:
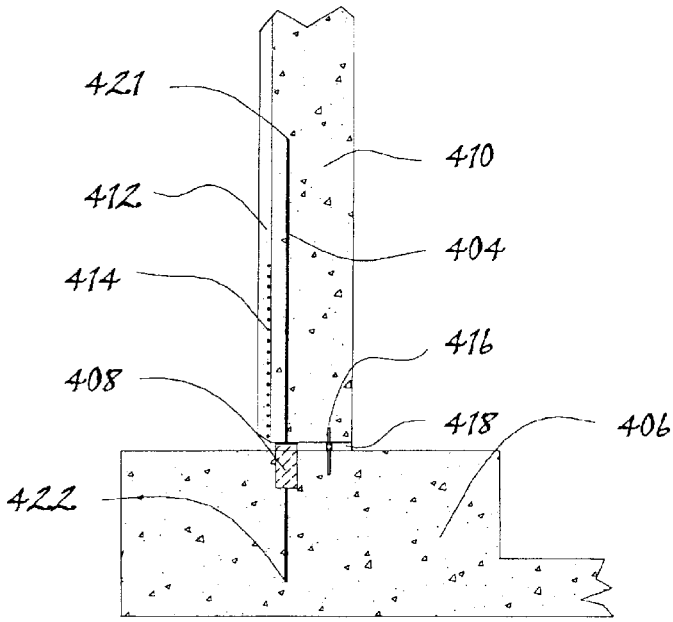
FIG. 4 is an elevation in cross section through the wall and base.
Figure 5:
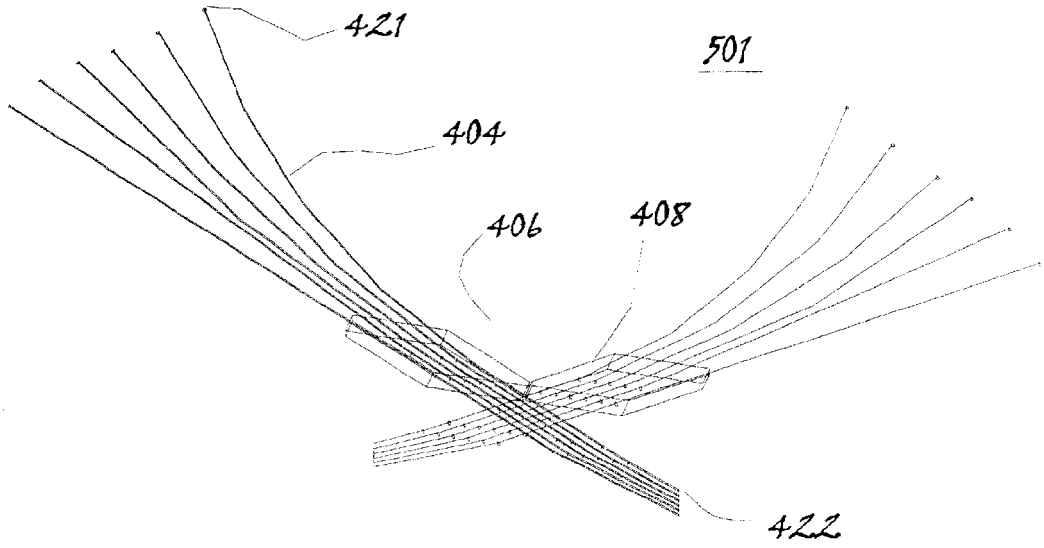
FIG. 5 is an elevation of the wire assembly

FIG. 4 shows the cross section of the lower portion for a typical circular concrete tank. The seismic cable 404 anchors into a footing 406 by traveling through a rubber sleeve 408. A rubber pad 418 is used to provide flexibility for the joint. A cover coat of shotcrete 412 is used to protect the prestressing wires or cables 414 from corrosion. Water stop 416 acts as a flexible barrier to water inside the tank.

A difference between this invention and the current method of placing seismic cables, is that epoxy is used to protect the seismic cables from liquids. End caps 421 and 422 are used to prevent liquid from entering the ends of the cable and traveling through the stranded cable.

Figure 6:
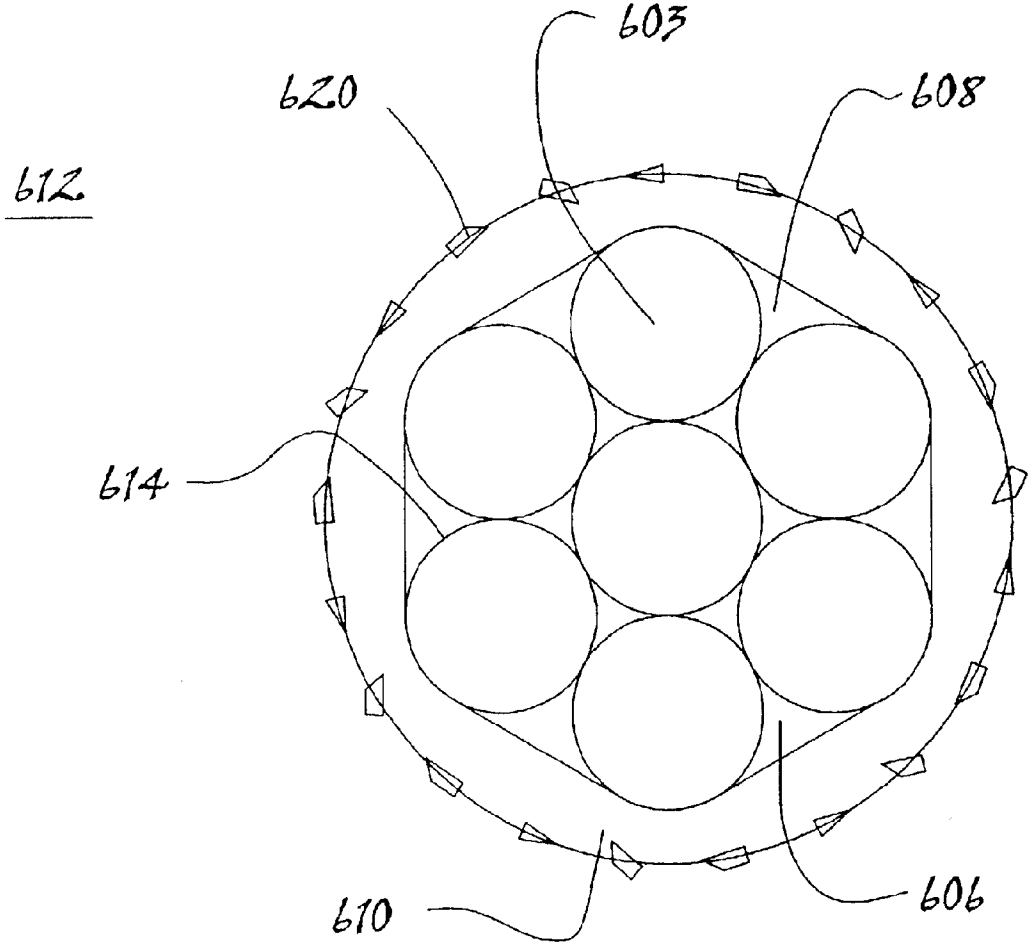
FIG. 6 is a cross section of the wire with epoxy filler.

Another method, as shown in FIG. 6, of accomplishing this is to fill the entire cable 404 with epoxy 606. This can be accomplished in an autoclave or by pumping and/or pulling epoxy 606 through the core 608 inside jacket 610. These epoxy-coated cables, generally designated 612, can also be protected by a sacrificial coating such as zinc 614 in addition to the epoxy filling and or covering.

Another aspect of this invention is to use abrasive material 620 on the outside of the jacket 610. This is to reduce the necessary development length of the cable so that it doesn't pull out of the wall or footing in the event of an earthquake.

What is claimed is:

1. A method of controlling a wire winder, said method including:

as a tower travels around a tank, generating a square wave from a wheel drive;

feeding said square wave to a counter and counting a number of said square waves;

comparing the number of counts with a number selected by an operator for a spacing location;

powering a proportional hydraulic valve, and thereby pressurizing fluid into an elevator hydraulic motor;

thereby rotating the motor until the spacing counter has counted the pre-selected number; and shutting the hydraulic flow.

2. A method according to claim 1 in which the square waves generated from the wheels and elevator motor are from optical encoders and fed to a counter.

3. A method according to claim 1 in which the square waves generated from the wheels and elevator motor are from segmental commutator rings and fed to a counter.

4. A method of according to claim 1 in which a strip chart recorder records information from various transducers as the tower travels.

5. A method according to claim 4 in which paper in the strip chart recorder is fed in direct relation to the movement of the tower so that the location of events recorded on the paper by the strip chart recorder can be related to the events.

6. A method according to claim 4 in which a controller automatically turns on the recorder on and selects an appropriate paper speed for paper used in the recorder.

7. A method according to claim 1 in which the square wave provides feedback for low cost proportional valves.

8. A winder for tensioning a strand of material being wrapped around a tank in order to pre-stress the tank, the winder being connected to a tower traveling around the tank, the winder comprising:

a first rotating gripper engaging the strand of material at a first, constant radius;

a second rotating gripper downstream of the first gripper and engaging the strand of material, the second gripper using a differential winder to apply a tension to the strand which leaves the second gripper;

a brake between the first and second gripper;

a brake on the first gripper to vary the rotation of the first gripper and vary the tension in the strand of material between the first and second grippers.

9. The winder of claim 8, wherein the brake on the first gripper is a stationary brake.

10. The winder of claim 9, further comprising a balance motor driving the second gripper.

11. The winder of claim 8, wherein the brake on the first gripper is a liquid cooled brake.

12. The winder of claim 11, further comprising a balance motor driving the second gripper.

13. The winder of claim 8, further comprising a balance motor driving the second gripper.

14. The winder of claim 8, wherein the first gripper receives the strand directly from a spool.

15. The winder of claim 8, wherein the second gripper comprises a sprocket with two different pitch circumferences.

* * * * *